US009695535B2

(12) United States Patent
Shomura

(10) Patent No.: US 9,695,535 B2
(45) Date of Patent: Jul. 4, 2017

(54) OVERLOCK SEWING MACHINE

(71) Applicant: Janome Sewing Machine Co., Ltd., Tokyo (JP)

(72) Inventor: Eiichi Shomura, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 301 days.

(21) Appl. No.: 14/719,068

(22) Filed: May 21, 2015

(65) Prior Publication Data

US 2016/0160417 A1 Jun. 9, 2016

(30) Foreign Application Priority Data

Dec. 5, 2014 (JP) ..... 2014-247101

(51) Int. Cl.

| | |
|---|---|
| ***B65H 57/00*** | (2006.01) |
| ***D05B 87/00*** | (2006.01) |
| ***D05B 57/34*** | (2006.01) |
| ***D05B 63/00*** | (2006.01) |
| ***D05B 1/20*** | (2006.01) |
| ***D05B 69/02*** | (2006.01) |

(52) U.S. Cl.

CPC ..... *D05B 87/00* (2013.01); *D05B 1/20* (2013.01); *D05B 57/34* (2013.01); *D05B 63/00* (2013.01); *D05B 69/02* (2013.01)

(58) Field of Classification Search

CPC ..... D05B 87/00; D05B 87/02; D05B 63/00; D05B 57/00; D05B 57/02; D05B 57/30; D05B 57/34; D05B 1/12; D05B 1/20; B65H 57/12

See application file for complete search history.

(56) References Cited

U.S. PATENT DOCUMENTS

| | | | | |
|---|---|---|---|---|
| 5,301,622 A * | 4/1994 | Sakuma | ..... | D05B 7/06 112/162 |
| 5,327,841 A | 7/1994 | Sakuma | | |
| 5,471,941 A * | 12/1995 | Sakuma | ..... | D05B 47/04 112/255 |
| 6,880,472 B2 * | 4/2005 | Horiuchi | ..... | D05B 87/02 112/199 |

(Continued)

FOREIGN PATENT DOCUMENTS

| | | |
|---|---|---|
| EP | 2878724 A1 | 6/2015 |
| JP | 05-228285 A | 9/1993 |

(Continued)

OTHER PUBLICATIONS

Patent Examination Report issued in Australian Patent Application No. 2015202852, dated on Jan. 22, 2016 (5 pages).

*Primary Examiner* — Nathan Durham

(74) *Attorney, Agent, or Firm* — Nakanishi IP Associates, LLC

(57) ABSTRACT

A overlock sewing machine includes a switch limiting arm rockable integrally with a main shaft fixing operating arm and an arm including arms which are actuated by operating a threading switching knob to engage with the switch limiting arm to rock a rocking lever portion and being engageable with a slide plate to move the position of the slide plate to a sewing executable position upon operating the threading switching knob to the sewing executing position side.

4 Claims, 17 Drawing Sheets

(56) References Cited

U.S. PATENT DOCUMENTS

| | | | | |
|---|---|---|---|---|
| 7,523,712 | B2 * | 4/2009 | Sadasue | D05B 1/10 112/199 |
| 7,536,964 | B2 * | 5/2009 | Sadasue | D05B 57/30 112/199 |
| 8,857,354 | B2 * | 10/2014 | Sakuma | D05B 87/00 112/199 |
| 8,925,472 | B2 * | 1/2015 | Sakuma | D05B 87/00 112/199 |
| 2008/0257241 | A1 * | 10/2008 | Sadasue | D05B 81/00 112/225 |
| 2012/0210922 | A1 | 8/2012 | Sakuma et al. | |
| 2014/0083344 | A1 | 3/2014 | Sakuma et al. | |
| 2014/0190383 | A1 * | 7/2014 | Ishikawa | D05B 63/00 112/199 |
| 2015/0167218 | A1 * | 6/2015 | Sakuma | D05B 63/00 112/302 |
| 2015/0267333 | A1 | 9/2015 | Shomura | |

FOREIGN PATENT DOCUMENTS

| | | | |
|---|---|---|---|
| JP | 2013-000338 | A | 1/2013 |
| WO | 2014/010108 | A1 | 1/2014 |

* cited by examiner

OVERLOCK SEWING MACHINE

CROSS REFERENCE TO RELATED APPLICATIONS

This application is based on and claims the benefit of priority to Japanese Patent Application No. 2014-247101 filed on Dec. 5, 2014, the content of which is hereby incorporated by reference in its entirety.

TECHNICAL FIELD

The present invention relates to an overlock machine capable of threading looper threads to loopers utilizing force of air.

BACKGROUND ART

An overlock sewing machine is provided with a plurality of loopers. It is necessary to thread each of the loopers with respectively different looper threads, and threading operations were troublesome.

Patent Literature 1 discloses a device for threading a thread to a hollow looper point using compressed air.

According to the device disclosed in Patent Literature 1, when a threading enabled phase is detected and the phase is to be maintained, it is necessary to simultaneously perform operations of pressing a fixing button and operations of rotating a thread take-up lever, so that the operations have needed by means of using both hands.

Moreover, according to the device disclosed in Patent Literature 2, the device has a push button including a control pin and a control groove cam portion receiving the control pin, wherein a user become possible to operate the push button, the control groove cam portion and a main shaft respectively by means using one hand.

On the other hand, in the device of Patent Literature 2, a user become possible to operate by means using one hand, and a user need to operate another return lever for releasing the threading state. Accordingly, a user needs to operate two operating members for performing switching between two modes, so that user-friendliness is poor.

PRIOR ART LITERATURE

Patent Literature

[Patent Literature 1] Japanese Patent Laid-Open Publication No. H05-228285

[Patent Literature 2] Japanese Patent Laid-Open Publication No. 2013-338

SUMMARY OF THE INVENTION

One or more embodiments of the present to provide an overlock machine capable of easily switching between a threading state and a sewing executable state.

EMBODIMENT (1)

One or more embodiments of the present invention provide an overlock sewing machine includes:

at least one looper including an receiving opening for receiving a looper thread and having a hollow structure through which the looper thread passes;

a thread inserting opening into which the looper thread to be inserted to the looper is inserted;

a looper conducting pipe which guides the looper thread inserted into the thread inserting opening towards the receiving opening;

a slide pipe provided between the looper conducting pipe and the receiving opening and which one end is fitted to the looper conducting pipe in a freely slidable manner while its other end is provided to be movable between a threading position at which it is connected to the receiving opening and a sewing executing position at which the other end is separated from the receiving opening;

a slide member which is a member holding the slide pipe and moving between the threading position and the sewing executing position together with the slide pipe, having a long hole portion extending along the moving direction and a wide hole portion being formed and connected with the long hole portion having a width formed to be larger than the width of the long hole portion;

a slide member spring (supporting plate shaft spring) urging the slide member and the slide pipe towards the receiving opening side;

a main shaft which is rotationally driven; a main shaft fixing plate being fixed to the main shaft and including a notch at an outer peripheral position corresponding to a threading phase at which the receiving opening and the other end of the slide pipe are at a connectable position;

a first shaft which is an axial member which one end is provided to be movable between an engaging position at which it engages with the notch for fixing the main shaft at the threading phase and a retracted position at which it is completely separated from the main shaft fixing plate and comprising a small diameter portion and a large diameter portion at the other end thereof which respectively engage with the long hole portion and the wide hole portion of the slide member;

wherein the position of the sliding member is maintained at each of the threading position and the sewing executing position through the engagement of the small diameter portion and the large diameter portion with the long hole portion and the wide hole portion;

a second shaft provided to be relatively movable along an axial direction of the first shaft;

a shaft spring for urging the first shaft and the second shaft in mutually separating directions; a shaft pin provided at the second shaft to project from the second shaft or engaging with the second shaft to be integrally movable in an axial direction of the second shaft;

an engaging portion provided at the first shaft to engage with the shaft pin and/or the second shaft to receive force to move the first shaft towards the main shaft fixing plate side;

a rocking lever portion including a main shaft fixing operating arm portion provided with a shaft pin engaging portion which engages with the shaft pin or with the shaft pin and a switch limiting portion being rockable integrally with the main shaft fixing operating arm portion and being provided to be rockable within a predetermined range; a main shaft fixing operating spring which urging direction is switched to both rocking directions of the rocking lever portion by exceeding a neutral point through rocking operations of the rocking lever portion;

a switch operating portion provided to be operable by a user; and a switch interlocking portion (switch interlocking arm) including switch engaging portions being actuated through operation of the switch operating portion and engaging with the switch limiting portion so as to rock the rocking lever portion and including a slide member engaging portion being engageable with the slide member so as to move the position of the slide member to the sewing executing position upon operating the switch operating portion to the sewing executing position side.

EMBODIMENT (2)

One or more embodiments of the present invention provide an overlock sewing machine includes:

a casing member formed with an opening portion visible at least to the user at the time of operation, wherein a part of the first shaft and/or a part of an identifying member moving integrally with the first shaft comes to a position at which it is exposed from the opening portion when the first shaft has moved to the retracted position to indicate that the sewing machine is in a sewing executable state in which the slide pipe and the slide member have moved to the sewing executing position so as to enable sewing.

EMBODIMENT (3)

One or more embodiments of the present invention provide an overlock sewing machine includes:

a switch allowing driving of a motor for driving the main shaft only when the first shaft has moved to the retracted position so that the sewing machine is in a sewing executable state so as to enable sewing.

According to one or more embodiments of the present invention, the overlock machine is capable of easily switching between a threading state and a sewing executable state.

DETAILED DESCRIPTION

An example for carrying out the present invention will now be explained with reference to the drawings and others.

Embodiment

Figure 1:
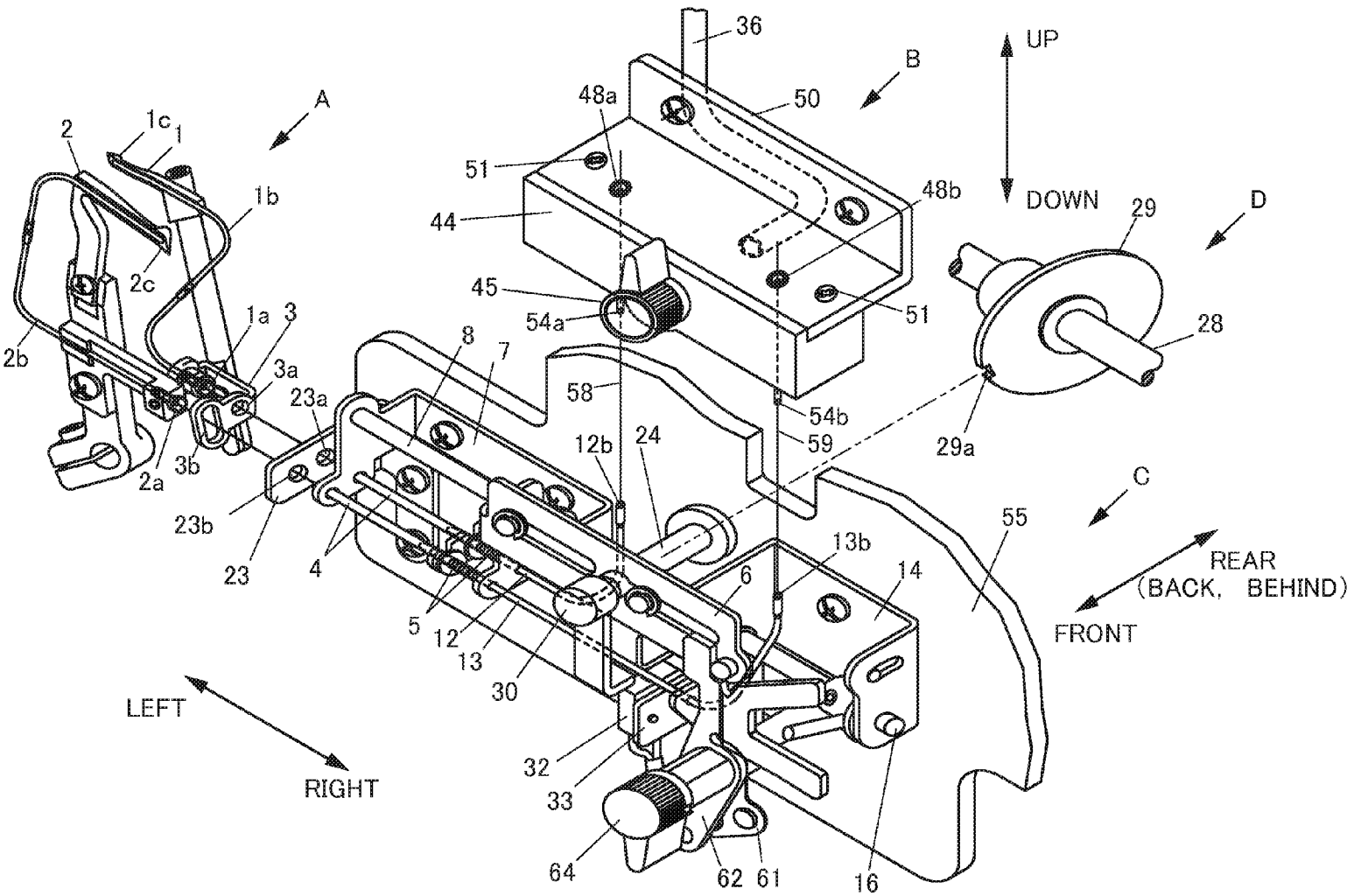
FIG. 1 is a perspective view of main portions for showing an overlock sewing machine according to one or more embodiments of the present invention.

FIG. 1 is a perspective view of main portions of an overlock sewing machine according to one or more embodiments of the present invention.

Figure 2:
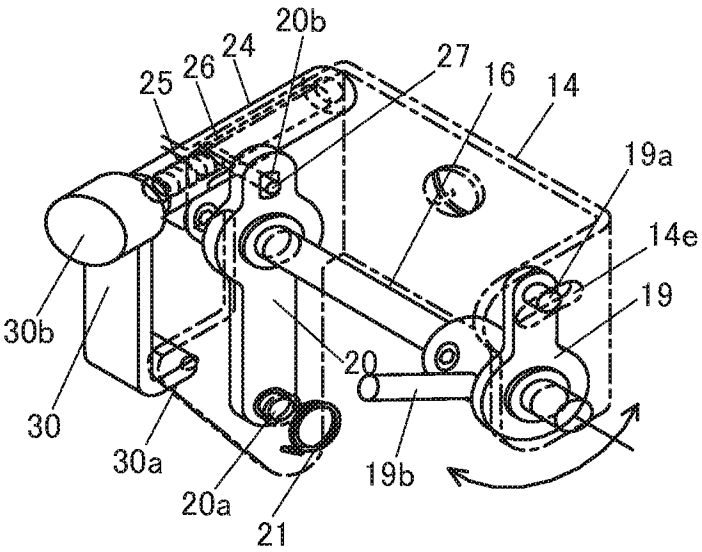
FIG. 2 is a perspective view showing an arrangement of a looper thread path C proximate of its right end portion by a state of seeing through a slide plate support 14.

FIG. 2 is a perspective view showing an arrangement of a looper thread path C proximate of its right end portion by a state of seeing through a slide plate support 14.

Figure 3:
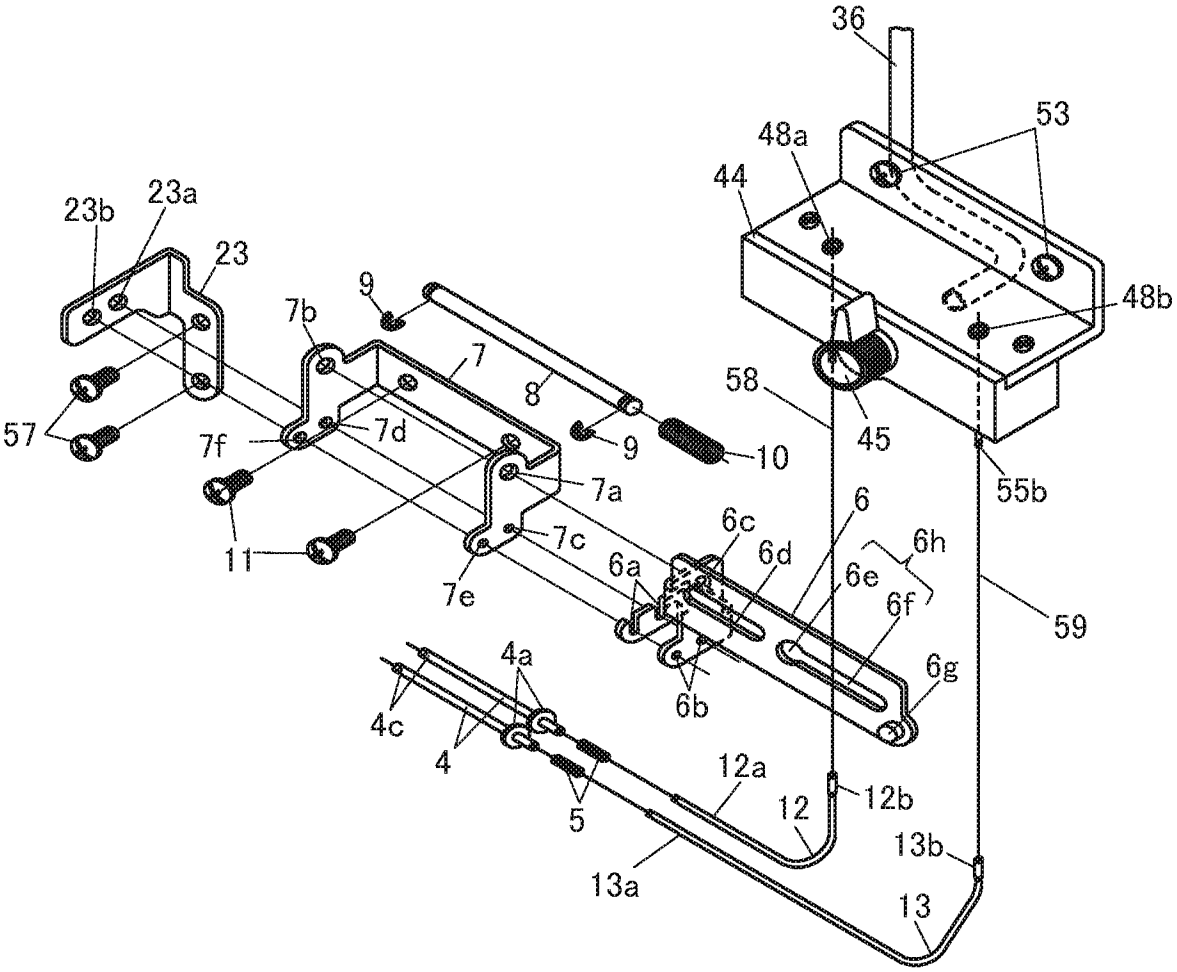
FIG. 3 is an exploded perspective view proximate of a slide plate 6 of the looper thread path C.

FIG. 3 is an exploded perspective view proximate of a slide plate 6 of the looper thread path C.

Figure 4:
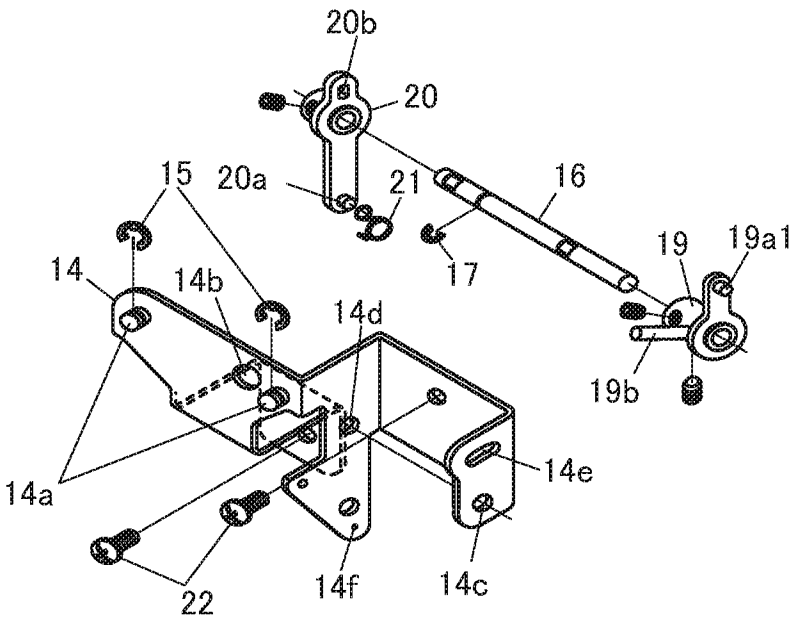
FIG. 4 is an exploded perspective view proximate of the slide plate support 14 of the looper thread path C.

FIG. 4 is an exploded perspective view proximate of the slide plate support 14 of the looper thread path C.

Figure 5:
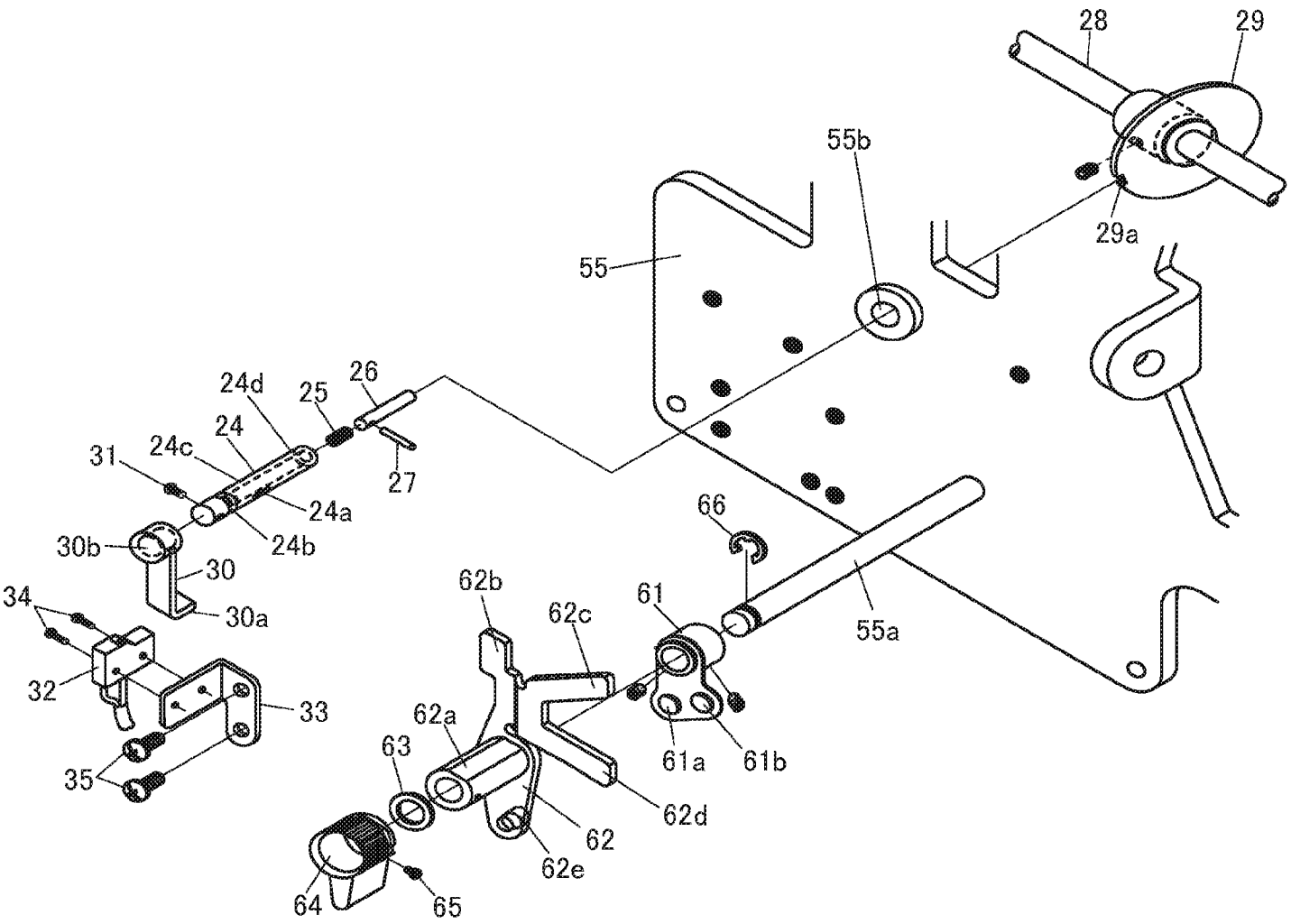
FIG. 5 is an exploded perspective view of a main shaft fixing mechanism D.

FIG. 5 is an exploded perspective view of a main shaft fixing mechanism D.

In this respect, each of the drawings indicated hereinafter including FIG. 1 to FIG. 5 are schematically illustrated drawings, and sizes and shapes of respective portions are shown in suitably exaggerated form for ease of understanding.

Further, while explanations are made upon indicating specific numerical values, shapes and materials in the following explanations, they may be suitably changed.

Moreover, for ease of understanding and for convenience sake, explanations will be made by suitably using the six directions of front (or near), rear (or back, behind), left, right, up and down as indicated by arrows in FIG. 1. However, these directions are not to limit the arrangement of the invention.

In the present embodiment, explanations will be made by giving a case of an overlock sewing machine comprising two loopers (upper looper 1, lower looper 2). However, the present invention is also applicable to sewing machines in which threading to one or more than three loopers is performed.

Main arrangements of the overlock sewing machine according to the present embodiment includes a looper portion A, an air flow path switching mechanism B, a looper thread path C and a main shaft fixing mechanism D as shown in FIG. 1. In this respect, while the overlock sewing machine further comprises needles, a motor and various driving mechanisms, details thereof will be omitted here.

The looper portion A comprises an upper looper 1 and a lower looper 2 of hollow structure for receiving an upper looper thread 58 and a lower looper thread 59 which are sent by means of the air flow path switching mechanism. B and the looper thread path C. The upper looper 1 and the lower looper 2 respectively include an upper looper receiving opening 1*a* and a lower looper receiving opening 2*a* for receiving the respective looper threads.

The upper looper receiving opening 1*a* communicates up to an upper looper point 1*c* via a pipe-like member 1*b*. The lower looper receiving opening 2*a* communicates up to a lower looper point 2*c* via a pipe-like member 2*b*. A looper thread take-up 3 includes an upper looper thread hook 3*a* and a lower looper thread hook 3*b*. The upper looper 1 and the lower looper 2 perform reciprocating movements while keeping intersection timings with a needle (not shown) which is vertically moved through rotation of a main shaft 28 driven by a motor (not shown).

The air flow path switching mechanism B is a mechanism for switching a flow path of compressed air supplied to a tube 36 so as to switch between threading of the upper looper thread 58 and threading of the lower looper thread 59. The air flow path switching mechanism B is configured in that a branching body 44 is fixed to a branching base plate 50 by means of screws 51 whereas the tube 36 is coupled to a rear surface thereof, and compressed air generated by a compressed air generator (not shown) is supplied to the air flow path switching mechanism B.

A looper selecting knob 45 is provided on a front surface of the air flow path switching mechanism B, and by operating this looper selecting knob 45, it is possible to set which of the upper looper thread 58 and the lower looper thread 59 is to be threaded at the time of performing threading operations.

An upper looper thread inserting hole 48*a* and a lower looper thread inserting hole 48*b* are disposed on an upper surface of the air flow path switching mechanism B.

The air flow path switching mechanism B includes an upper looper thread discharge pipe 54*a* and a lower looper thread discharge pipe 54*b* at a lower end thereof which are coupled with upper end expanding portions 12*b*, 13*b* of an upper looper conducting pipe 12 and a lower looper conducting pipe 13 to be described later.

The air flow path switching mechanism B is fixed to a main body of the sewing machine or a unit base 55 by means of screws 53.

Slide pipes 4 receive slide pipe springs 5 at their flange portions 4*a* and are inserted into U grooves 6*a* of a slide plate 6 using the flange portions 4*a* as strike plates. Respective one ends 4*b* of the slide pipes 4 are fitted to the upper looper conducting pipe 12 and the lower looper conducting pipe 13 in a freely sliding manner. The slide pipes 4 further move between a threading position and a sewing executing position following movements of the slide plate 6. In the threading position, other ends 4*c* of the slide pipes 4 are in a state in which they are connected to the upper looper receiving opening 1*a* and the lower looper receiving opening 2*a*. At the sewing executing position, the other ends 4*c* of the slide pipes 4 are in a state in which they are separated from the upper looper receiving opening 1*a* and the lower looper receiving opening 2*a*.

The slide pipe springs 5 fit with the slide pipes 4 and press and contact with the slide pipes 4 against the upper looper receiving opening 1*a* and the lower looper receiving opening 2*a* when moving the slide pipes 4 to the threading position.

The slide plate (slide member) 6 includes two round holes 6*b* on an opposite side corresponding to the two U grooves 6*a*. The portion of the slide plate 6 including the U grooves 6*a* and the round holes 6*b* is disposed on an inner region (region pinched by opposing portions to be described later) of a looper pipe supporting plate 7. The slide plate 6 holds the slide pipes 4 and moves between the threading position and the sewing executing position together with the slide pipes 4.

The looper pipe supporting plate 7 is formed to have a shape in which its opposing portions, which are provided on both sides of portions extending in lateral directions to oppose each other, are respectively bent frontward to standup (so-called U-shaped form). The looper pipe supporting plate 7 includes through holes 7*a*, 7*b* at the opposing portions. The slide plate 6 is formed with a round hole 6*c* corresponding to the through holes 7*a*, 7*b* on the same surface as the above-mentioned two round holes 6*b*.

A supporting plate shaft 8 pierces through the through holes 7*a*, 7*b* of the looper pipe supporting plate 7 and the round hole 6*c* of the slide plate 6, and is fixed to the looper pipe supporting plate 7 by fastening E-shaped snap rings 9 to both ends thereof. The supporting plate shaft 8 maintains a supporting plate shaft spring 10 between the round hole 6*c* of the slide plate 6 and the through hole 7*a* of the looper pipe supporting plate 7. Since the looper pipe supporting plate 7 is fixed to the main body of the sewing machine (not shown) or the unit base 55 by means of screws 11, the slide plate 6 is continuously urged in the a left direction by means of the supporting plate shaft spring 10.

The supporting plate shaft spring 10 constantly urges the slide plate 6 and the slide pipes 4 in the left direction and serves as a driving source for moving the slide plate 6 and the slide pipes 4 in the left direction at the time of switching threading.

A linear portion 12*a* of the upper looper conducting pipe 12 pierces through a right side surface hole 7*c* of the looper pipe supporting plate 7 and one round hole 6*b* of the slide plate 6, pierces further through the slide pipe spring 5 and one slide pipe 4 and pierces up to a left side surface hole 7*d* of the looper pipe supporting plate 7 together with the slide pipe 4.

A linear portion 13*a* of the lower looper conducting pipe 13 pierces through a right side surface hole 7*e* of the looper pipe supporting plate 7 and the other round hole 6*b* of the slide plate 6, pierces further through the slide pipe spring 5 and the other slide pipe 4 and pierces up to a left side surface hole 7*f* of the looper pipe supporting plate 7 together with the slide pipe 4.

The slide plate 6 includes a long hole 6*d* and a heteromorphic long hole 6*h*.

The heteromorphic long hole 6*h* includes a long hole portion 6*f* extending along a moving direction of the slide plate 6 (lateral direction), and a wide hole portion 6*e* that is formed and connected with the long hole portion 6*f* and to have a width that is formed to be larger than the width of the long hole portion 6*f*.

The slide plate 6 further includes a pin 6*g* projecting to the front side proximate of a right side end portion thereof.

A slide plate support 14 is fixed to the main body of the sewing machine (not shown) or the unit base 55 by means of screws 22. The slide plate support 14 holds the slide plate 6 and the main shaft fixing outer shaft 24. The slide plate support 14 further holds a main shaft fixing operating shaft 16, the main shaft fixing operating arm 20 and a switching limiting arm 19.

A pin with E grooves 14*a* is disposed on end of the slide plate support 14, and a pin with E grooves 14*a* is similarly disposed also on the other end thereof. The slide plate support 14 holds the slide plate 6 in a freely sliding manner by being fixed by E-shaped snap rings 15 in a condition in which the pins with E grooves 14*a* are fitted to each of the long hole 6*d* and the long hole portion 6*f* of the slide plate 6.

The slide plate support 14 includes a round hole 14*b* at substantially the center thereof, and the main shaft fixing outer shaft 24 pierces through the round hole 14*b*. The slide plate support 14 includes through holes 14*c*, 14*d* on a right half portion thereof. The main shaft fixing operating shaft 16 pierces through the through holes 14*c*, 14*d*, and the main shaft fixing operating shaft 16 is provided at the slide plate support 14 to be freely rotating by means of an E-shaped snap ring 17.

The switch limiting arm (switch limiting portion) 19 is fixed at the main shaft fixing operating shaft 16 on a substantially U-shaped inner side provided on the right side of the side plate support 14 and is held to be freely rotating integrally with the main shaft fixing operating arm 20 upon eliminating backlash in a thrust direction in coaction with the E-shaped snap ring 17.

A pin 19*a* is disposed at an upwardly extending arm of the switch limiting arm 19. The pin 19*a* fits into an arc-shaped long hole 14*e* located on a right end of the slide plate support 14 in a freely rocking manner. Through this fitting of the arc-shaped long hole 14*e* and the pin 19*a*, a rocking range of the switch limiting arm 19 is restricted.

Further, the switch limiting arm 19 includes a pin 19*b* extending to the near side. Arms 62*c*, 62*d* of a switch interlocking arm 62 to be described later are engageable with the pin 19*b*.

The main shaft fixing operating arm (main shaft fixing operating arm portion) 20 is fixed to a left end of the main shaft fixing operating shaft 16. The main shaft fixing operating arm 20 performs rocking movements integrally with the switch limiting arm 19 via the main shaft fixing operating shaft 16. A pin 20*a* is disposed at one end of the main shaft fixing operating arm 20, and a main shaft fixing operating spring 21 is suspended between the pin and a small hole 14*f* of the slide plate support 14. The main shaft fixing operating spring 21 alternately performs urging movements in bipolar directions exceeding the neutral point through the rocking movements of the main shaft fixing operating arm 20. There is further provided a shaft pin engaging portion 20*b* formed to have a long hole shape at one end of the main shaft fixing operating arm 20. A fixing inner shaft pin 27 to be described later is engaged with the shaft pin engaging portion 20*b*. The main shaft fixing operating arm 20 moves a main shaft fixing inner shaft 26 and the main shaft fixing outer shaft 24 forward and backward with the shaft pin engaging portion 20*b* pressing the fixing inner shaft pin 27.

The main shaft fixing operating arm 20 is arranged in that it is alternately urged to the near side and the back side exceeding the neutral point through the action of the main shaft fixing operating spring 21. The main shaft fixing operating arm 20 is restricted in its rocking range through the fitting of the arc-shaped long hole 14*e* of the slide plate support 14 and the pin 19*b* of the switch limiting arm 19.

In this respect, in the present embodiment, the rocking lever portion provided to be rocking within a specified range is comprised of the main shaft fixing operating shaft 16, the switch limiting arm 19, and the main shaft fixing operating arm 20 as described above. However, the rocking lever portion could also be arranged by integrating a part or all of these parts.

A switch shaft 55*a* is provided at the unit base 55 to extend forward. In this respect, the switch shaft 55*a* might be provided at the main body of the sewing machine or the like. An interlocking arm receiver 61 is inserted into the switch shaft 55*a* and is fixed thereat by means of a screw 61*c*, and the switch interlocking arm 62 is fitted on the nearer side in a freely rotatable manner.

The interlocking arm receiver 61 is formed with concave portions 61*a*, 61*b* which are formed to dent rearward and align in the rotating direction.

The switch interlocking arm 62 includes a boss portion 62*a*, arms 62*b*, 62*c*, 62*d* and a spherical protrusion 62*e*.

The boss portion 62*a* is formed to have a hollow substantially rod-like shape, wherein the switch shaft 55*a* pierces through the hollow portion, and a washer 63 and a E-shaped snap ring 66 are provided on the near side of the switch interlocking arm 62 so as to restrict movements of the switch interlocking arm 62 in the axial direction by interposing the switch interlocking arm 62 between the interlocking arm receiver 61 and the E-shaped snap ring 66.

The arm portion (slide member engaging portion) 62*b* is provided to extend upward from the boss portion 62*a*. A right end portion of the tip of the arm 62*b* can abut the pin 6*g* of the slide plate 6. When the threading switching knob 64 to be described later is rotated in a clockwise direction when seen from the front, the switch interlocking arm 62 rotates with the threading switching knob 64 such that the arm 62*b* pushes the pin 6*g*, and the slide plate 6 can be moved to the right side.

The arm portion (switch engaging portion) 62*c* is provided to extend from upward of the arm 62*b* towards the right side.

The arm 62*d* (switch engaging portion) is provided to extend from upward of the arm 62*b* towards the right side.

The pin 19*b* of the switch limiting arm 19 is inserted into a substantially V-shaped space interposed between the arm 62*c* and the arm 62*d*, and the arm 62*c* or the arm 62*d* engages with the pin 19*b* in accordance with rotating directions of the threading switching knob 64.

The spherical protrusion 62*e* is formed to project rearward from a portion extending downward from the boss portion 62*a*. With the spherical protrusion 62*e* fitting into the concave portions 61*a*, 61*b* of the interlocking arm receiver 61, it is possible to temporally hold the rotating position of the switch interlocking arm 62.

The threading switching knob (switch operating portion) 64 is fitted with the boss portion 62*a* of the switch interlocking arm 62 and is fixed to the switch interlocking arm 62 by means of a screw 65. Accordingly, by operating the threading switching knob 64 to rock to the right and left (to rotate within a predetermined range), the switch interlocking arm 62 is also made to rock (to rotate within a predetermined range) integrally with the threading switching knob 64.

In a state in which the sewing machine is completed, the switch interlocking arm 62 is included an internal structure of a front surface cover 56 (see FIG. 7*c*) and threading switching knob 64 is an external part for the user to operate.

A looper thread take-up guide 23 is disposed on a left end of the looper thread path C. The looper thread take-up guide 23 is formed with two round holes 23*a*, 23*b* at positions corresponding to the left side surface holes 7*d* and 7*f* of the looper pipe supporting plate 7.

The looper thread take-up guide 23 is fixed to the main body of the sewing machine (not shown) or the unit base 55 by means of screws 57.

The main shaft fixing outer shaft (first shaft) 24 fitting with the round hole 14*b* of the slide plate support 14 has a hollow inner diameter portion, wherein a fixing inner shaft spring (shaft spring) 25 and the main shaft fixing inner shaft (second shaft) 26 are inserted into the hollow portion. Accordingly, the main shaft fixing inner shaft 26 is relatively movable along an axial direction of the main shaft fixing outer shaft 24. The main shaft fixing inner shaft 26 moves forward and backward through rocking movements of the main shaft fixing operating arm 20 through the fixing inner shaft pin 27 to be described later. The fixing inner shaft spring 25 urges to the direction in which the main shaft fixing outer shaft 24 and the main shaft fixing inner shaft 26 in mutually separating. With this arrangement, the fixing inner shaft spring 25 functions as an urging member for maintaining an intermediate position of the main shaft fixing outer shaft 24.

The fixing inner shaft pin (shaft pin) 27 is fixed such that it projects sideward to a tip end on the near side of the main shaft fixing inner shaft 26 through a side surface long hole (engaging portion) 24*a* of the main shaft fixing outer shaft 24. The fixing inner shaft pin 27 has a function of transmitting rocking movements of the main shaft fixing operating arm 20 to the main shaft fixing inner shaft 26. The fixing inner shaft pin 27 is movable in front and rear directions within a range in which the side surface long hole 24*a* of the main shaft fixing outer shaft 24 is formed, and in accordance therewith, the main shaft fixing inner shaft 26 moves within the main shaft fixing outer shaft 24. The side surface long hole 24*a* also has a function as an engaging portion that engages with the fixing inner shaft pin 27 to receive force of moving the main shaft fixing outer shaft 24 to a main shaft fixing plate 29 side.

The main shaft fixing plate 29 fixed to the main shaft 28 is disposed on an axial central line of the main shaft fixing outer shaft 24. The notch 29*a* that can fit with one end 24*d* of the main shaft fixing outer shaft 24 is disposed at a specified phase (corresponding to the threading phase) on an outer periphery of the main shaft fixing plate 29. When the main shaft fixing outer shaft 24 reaches a final position (engaging position), the one end 24*d* of the main shaft fixing outer shaft 24 engages with the notch 29*a* to fix the main shaft 28 at the threading phase.

A motor switch cap (identification member) 30 is fastened at a tip end on the near side of the main shaft fixing outer shaft 24 by means of a screw 31. The motor switch cap 30 moves back and forth integrally with the main shaft fixing outer shaft 24.

The motor switch cap 30 includes a switch contacting surface 30*a* at a tip end of a downwardly extended arm thereof.

A micro switch (switch) 32 is disposed at a lower portion of the motor switch cap 30. The micro switch 32 is fixed at a switch mounting plate 33 by means of screws 34. The switch mounting plate 33 is fixed to the main body of the sewing machine or the unit base 55 by means of screws 35.

A circuit of the present embodiment (not shown) is arranged in that a motor driving circuit is switched ON only when the main shaft fixing outer shaft 24 is at a foremost position which is a retracted position in which it is completely separated from the main shaft fixing plate 29, that is, when the motor switch cap 30 is at a foremost position. This state is a state in which the slide plate 6 and the slide pipes 4 have moved to the right, and corresponds to the sewing executable state.

The main shaft fixing outer shaft 24 includes a small diameter portion 24*b* and a large diameter portion 24*c* that respective engage with the long hole portion 6*f* and the wide hole portion 6*e* of the slide plate 6. The main shaft fixing outer shaft 24 maintains the position of the slide plate 6 at either the threading position or the sewing executing position through the engagement of the small diameter portion 24*b* and the large diameter portion 24*c* with the long hole portion 6*f* and the wide hole portion 6*e*.

With the above-described arrangement, one end of the main shaft fixing outer shaft 24 fits the notch 29*a* of the main shaft fixing plate 29 to fix the main shaft 28 at the specified phase. Further, the other end of the main shaft fixing outer shaft 24 fits the heteromorphic long hole 6*h* of the slide plate 6 to maintain the slide plate 6 at the threading position and the sewing executing position, respectively. Moreover, the main shaft fixing outer shaft 24 constitutes a unit of the main shaft fixing outer shaft 24 by accommodating the fixing inner shaft spring 25, the main shaft fixing inner shaft 26 and the fixing inner shaft pin 27 in an inner diameter hole portion thereof.

In the overlock sewing machine according to the present embodiment having the above-described arrangement, the upper looper 1 and the lower looper 2 hold the upper looper thread and the lower looper thread respectively, and mutually intersect with needle threads (not shown) held by needles, thereby form seams.

The looper thread path C couples with the main shaft fixing mechanism D and the air flow switching mechanism B. When the main shaft fixing outer shaft 24 pierces through the main body of the sewing machine or the base unit 55 and fits with the notch 29*a* of the main shaft fixing plate 29 fixed to the main shaft 28, the loop thread path C sends the respective looper threads to the upper looper 1 or the lower looper 2 as set by the looper selecting knob 45 through compressed air that is send through the tube 36. The upper looper thread discharge pipe 54*a* and the lower looper thread discharge pipe 54*b* at a terminal end of the air flow switching mechanism B are coupled to the upper end expanding portion 12*b* of the upper looper conducting pipe 12 and the lower end expanding portion 13*b* of the lower looper conducting pipe 13 which are inlets on the looper thread path C side to communicate compressed air.

In the phase at which the main shaft fixing outer shaft 24 and the notch 29*a* of the main shaft fixing plate 29 meet, the timing is set that the upper looper receiving opening 1*a* and the lower looper receiving opening 2*a* coincide horizontally at the looper portion A, and they reach on an extension of the slide pipes 4.

Setting of the threading state and the sewing executing state is performed either by either pressing the main shaft fixing outer shaft 24 to the main shaft fixing plate 29 side to fit with the notch 29*a*, or by pulling the main shaft fixing outer shaft 24 to the near side to release the fitting with the notch 29*a*. It is able to set by operating to rock (operating to rotate within a predetermined range) the threading switching knob 64, and by operating the thread take-up lever (not shown) (which rotates simultaneously with the main shaft).

When setting the threading state, it is possible to perform setting by manually rotating the thread take-up lever after operating the thread switching knob 64 counterclockwise. By operating the thread switching knob 64 counterclockwise, the switch limiting arm 19 and the main shaft fixing operating arm 20 rotate clockwise when seen from the right side surface of the sewing machine so as to urge the main shaft fixing outer shaft 24 to the back side (rearward).

When the take-up lever is rotated and the notch 29*a* of the main shaft fixing plate 29 coincides with the position of the main shaft fixing outer shaft 24, the main shaft fixing outer shaft 24 plunges into the notch 29*a* upon being urged by the main shaft fixing operating spring 21. This is, the fitting have completed.

When setting the sewing executing state, the thread switching knob 64 is operated clockwise. With this arrangement, the switch limiting arm 19 and the main shaft fixing operating arm 20 rotate counterclockwise when seen from the right side of the sewing machine so as to urge the main shaft fixing outer shaft 24 to the near side. At this time, since the slide plate 6 is also pulled back in the right direction by the switch interlocking arm 62, the heteromorphic long hole 6*h* of the slide plate 6 slips sideward within the small diameter portion 24*b* of the main shaft fixing outer shaft 24 with which it had been fitted to reach the wide hole portion 6*e*, coincides with the outer diameter of the main shaft fixing outer shaft 24 and the outer shaft fixing outer shaft 24 is pushed to the near side. Consequently, fitting of the notch 29*a* of the main shaft fixing plate 29 and main shaft fixing outer shaft 24 is released to switch to the sewing executing state.

Next, switching operations between the threading state and the sewing executable state of the overlock sewing machine according to the present embodiment will be explained in details.

Figure 6A:
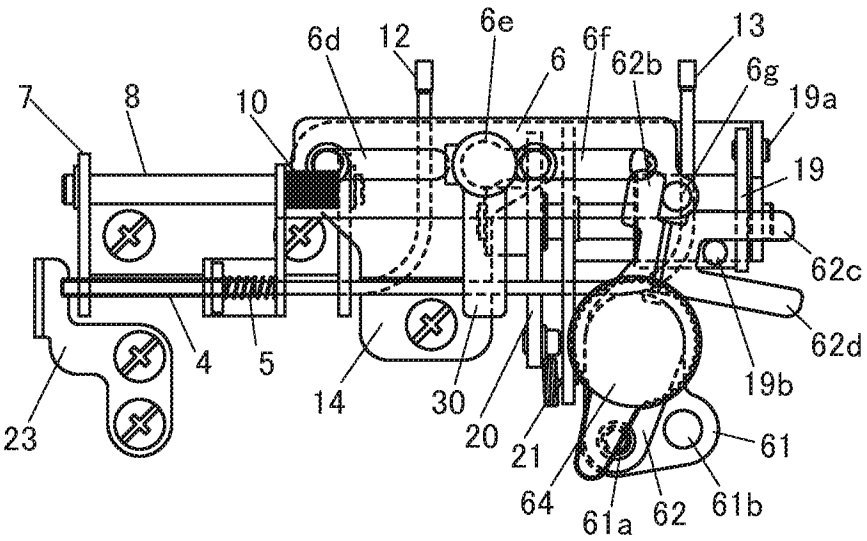
FIG. 6A is a view showing positions of a threading switching knob 64, the slide plate 6 and a slide pipe 4 in a sewing executable state.

FIG. 6A is a view showing positions of the threading switching knob 64, the slide plate 6 and the slide pipe 4 in a sewing executable state.

Figure 6B:
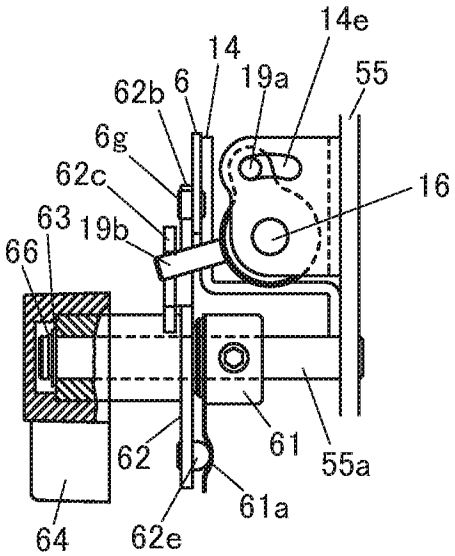
FIG. 6B is a view showing a switch limiting arm 19 in the sewing executable state.

FIG. 6B is a view showing the switch limiting arm 19 in the sewing executable state.

Figure 6C:
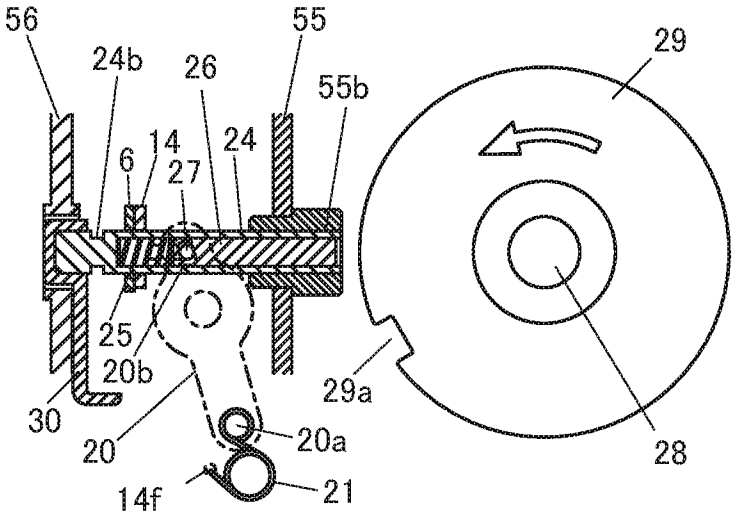
FIG. 6C is a view showing a relationship of a main shaft fixing operating arm 20, a main shaft fixing outer shaft 24 and a main shaft fixing inner shaft 26 in the sewing executable state.

FIG. 6C is a view showing a relationship of the main shaft fixing operating arm 20, the main shaft fixing outer shaft 24 and the main shaft fixing inner shaft 26 in the sewing executable state.

Figure 6D:
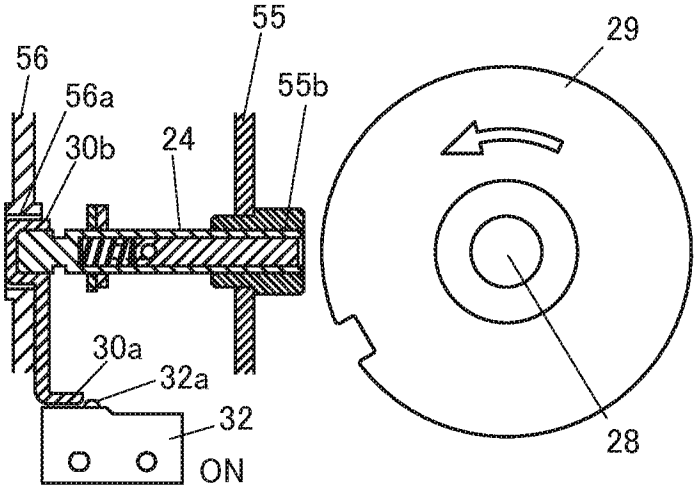
FIG. 6D is a view showing a relationship between a motor switch cap 30 and a micro switch 32 in the sewing executable state.

FIG. 6D is a view showing a relationship between the motor switch cap 30 and the micro switch 32 in the sewing executable state.

In the sewing executable state, the threading switching knob 64 is in a state in which it is rotated clockwise. As the arm 62*c* of the switch interlocking arm 62 pushes down the pin 19*b* of the switch limiting arm 19, the switch limiting arm 19 and the main shaft fixing operating arm 20 will rotate counterclockwise when seen from the right side surface of the sewing machine.

On the other hand, the arm 62*b* of the switch interlocking arm 62 will push the pin 6*g* of the slide plate 6 in a right direction, so that the slide plate 6 is moved to the right direction.

Consequently, the wide hole portion 6*e* of the slide plate 6 moves to a position at which it coincides with the main shaft fixing outer shaft 24, and the main shaft fixing outer shaft 24 is pushed out to the near side of the sewing machine because the main shaft fixing outer shaft 24 is urged in the near side direction by means of the fixing inner shaft pin 27 upon rotation of the main shaft fixing operating arm 20. Accordingly, fitting of the main shaft fixing outer shaft 24 and the notch 29*a* of the main shaft fixing plate 29 is released so that the main shaft 28 is made rotatable.

The switch interlocking arm 62 fixing the threading switching knob 64 stably maintains the threading switching knob 64 at the sewing executable state with the coincidence of the spherical protrusion 62*e* on one end and the concave portion 61*a* of the interlocking arm receiver 61.

Since the main shaft fixing outer shaft 24 has moved to the near side, the boss portion 30*b* of the motor switch cap 30 screwed to the main shaft fixing outer shaft 24 will stick its surface from the identification window 56*a* provided at the front surface cover 56 of the sewing machine. With this arrangement the user can confirm that the sewing machine is in a drivable state (sewing executable state).

Since the motor switch cap 30 has also moved to the near side accompanying the main shaft fixing outer shaft 24, the motor driving power source will be ON without actuating the button 32*a* of the micro switch 32, and the sewing machine is drivable.

In the sewing executable state, while the slide plate 6 is positioned at the right-most end and is urged in the left direction by means of the supporting plate shaft spring 10. Since the large diameter portion of the main shaft fixing outer shaft 24 and the wide hole portion 6*e* of the slide plate 6 fit with each other, movement of the slide plate 6 in the left direction is restricted. Further, with the arrangement, the slide pipes 4 are also maintained at the right-most position. Accordingly, the slide pipes 4 are remote from the fitting positions with the upper looper receiving opening 1*a* and the lower looper receiving opening 2*a* and are maintained in the sewing executing state.

Figure 7A:
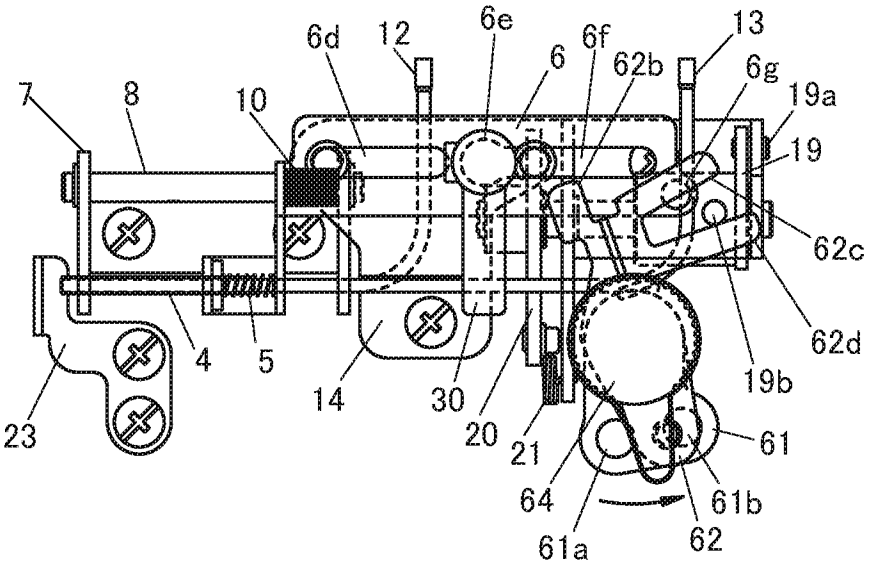
FIG. 7A is a view showing positions of the threading switching knob 64, the slide plate 6 and the slide pipe 4 in a state in which the threading switching knob 64 is rotating counterclockwise.

FIG. 7A is a view showing positions of the threading switching knob 64, the slide plate 6 and the slide pipe 4 in a state in which the threading switching knob 64 is rotating counterclockwise.

Figure 7B:
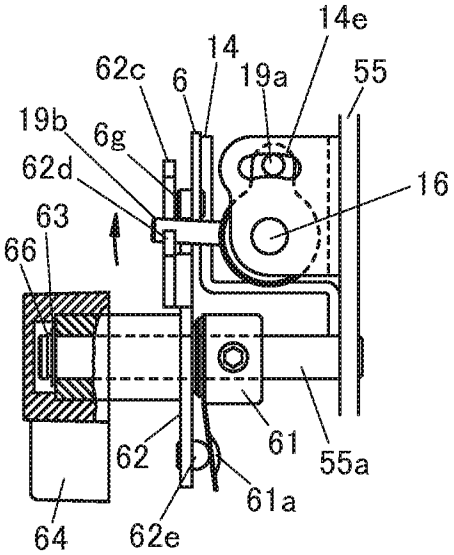
FIG. 7B is a view showing the switch limiting arm 19 in the state in which the threading switching knob 64 is rotating counterclockwise.

FIG. 7B is a view showing the switch limiting arm 19 in the state in which the threading switching knob 64 is rotating counterclockwise.

Figure 7C:
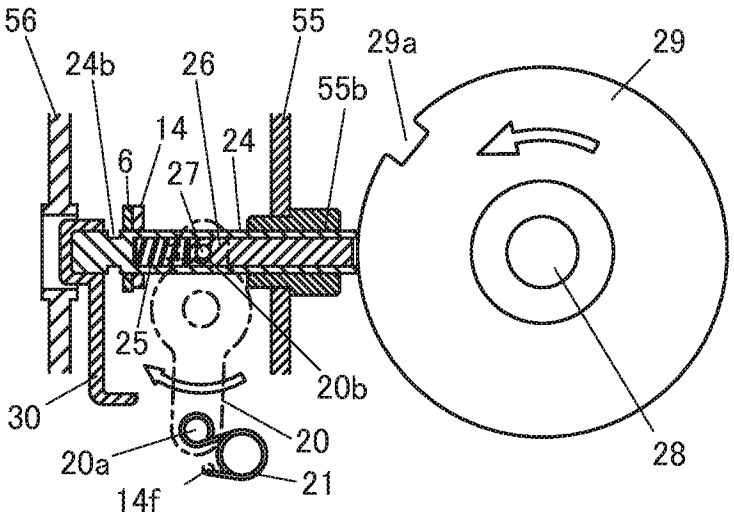
FIG. 7C is a view showing a relationship of the main shaft fixing operating arm 20, the main shaft fixing outer shaft 24 and the main shaft fixing inner shaft 26 in the state in which the threading switching knob 64 is rotating counterclockwise.

FIG. 7C is a view showing a relationship of the main shaft fixing operating arm 20, the main shaft fixing outer shaft 24 and the main shaft fixing inner shaft 26 in the state in which the threading switching knob 64 is rotating counterclockwise.

Figure 7D:
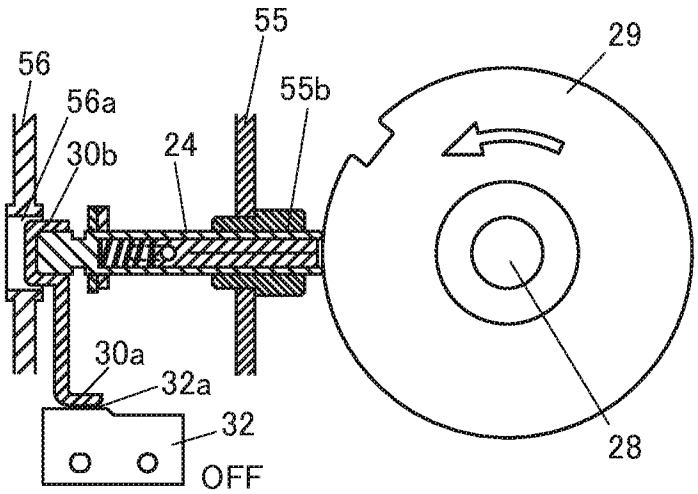
FIG. 7D is a view showing a relationship between the motor switch cap 30 and the micro switch 32 in the state in which the threading switching knob 64 is rotating counterclockwise.

FIG. 7D is a view showing a relationship between the motor switch cap 30 and the micro switch 32 in the state in which the threading switching knob 64 is rotating counterclockwise.

By rotating the threading switching knob 64 counterclockwise, the pin 19*b* of the switch limiting arm 19 is pushed up by the arm 62*d* of the switch interlocking arm 62, and the switch limiting arm 19 and the main shaft fixing operating arm 20 rotated clockwise when seen from the right side surface of the sewing machine. At this time, the notch 29*a* of the main shaft fixing plate 29 has not yet reached the phase at which it fits with the main shaft fixing outer shaft 24, so that the main shaft fixing outer shaft 24 comes into contact with the outer periphery of the main shaft fixing plate 29 and is held thereat. However, the main shaft fixing outer shaft 24 is continuously urged in the central axial direction of the main shaft fixing plate 29 by the main shaft fixing operating arm 20 and the fixing inner shaft pin 27 through the action of the main shaft fixing operating spring 21.

At this time, the switch contacting surface 30*a* of the motor switch cap 30 is in a state in which it presses the button 32*a* of the micro switch 32, namely, in which the motor driving power source is OFF. In this state, the motor does not operate upon trying to drive the motor by operating a foot controller.

While the slide plate 6 is urged in the left direction by means of the supporting plate shaft spring 10, since the wide hole portion 6*e* is fitted with the large diameter portion of the main shaft fixing outer shaft 24, it can still not move in the left direction. Accordingly, the slide plate 6 and the slide pipes 4 are maintained at the right-most positions, and it is similarly to the sewing executable state.

Figure 8A:
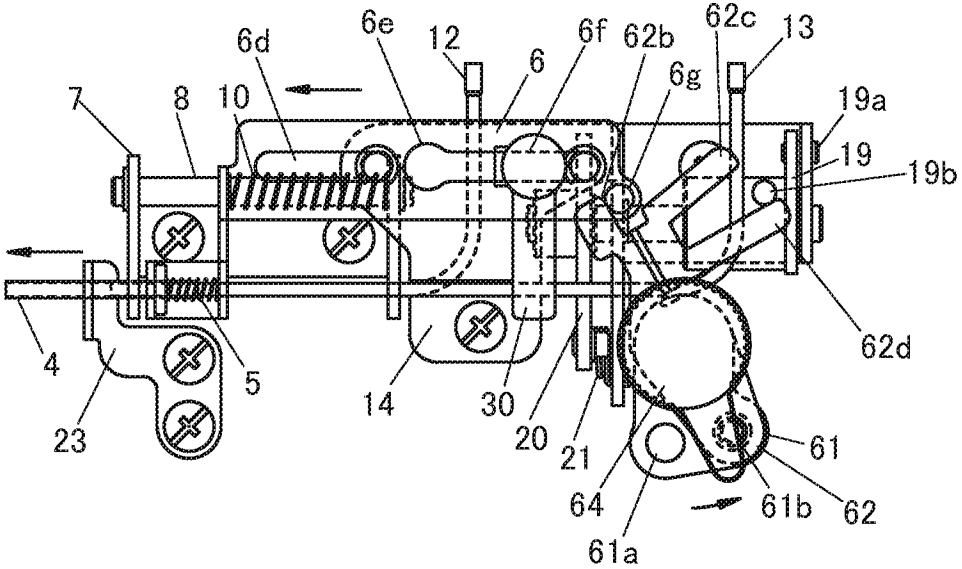
FIG. 8A is a view showing positions of the threading switching knob 64, the slide plate 6 and the slide pipe 4 in a state in which switching to a threading state is completed.

FIG. 8A is view showing positions of the threading switching knob 64, the slide plate 6 and the slide pipe 4 in a state in which switching to a threading state is completed.

Figure 8B:
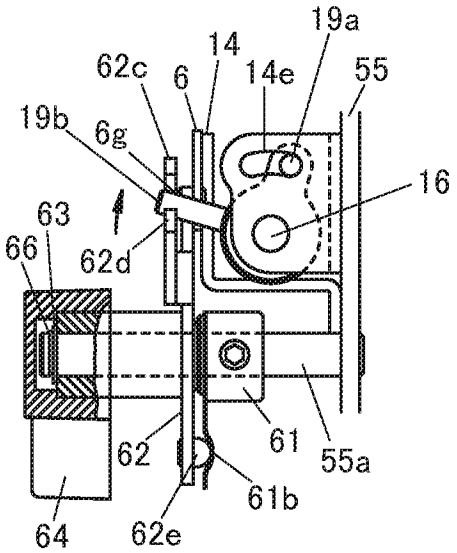
FIG. 8B is a view showing the switch limiting arm 19 in the state in which switching to the threading state is completed.

FIG. 8B is a view showing the switch limiting arm 19 in the state in which switching to the threading state is completed.

Figure 8C:
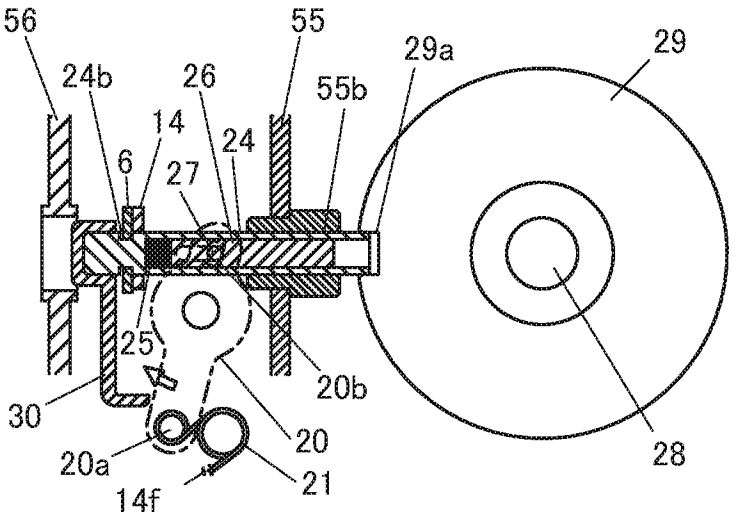
FIG. 8C is a view showing a relationship of the main shaft fixing operating arm 20, the main shaft fixing outer shaft 24 and the main shaft fixing inner shaft 26 in the state in which switching to the threading state is completed.

FIG. 8C is a view showing a relationship of the main shaft fixing operating arm 20, the main shaft fixing outer shaft 24 and the main shaft fixing inner shaft 26 in the state in which switching to the threading state is completed.

Figure 8D:
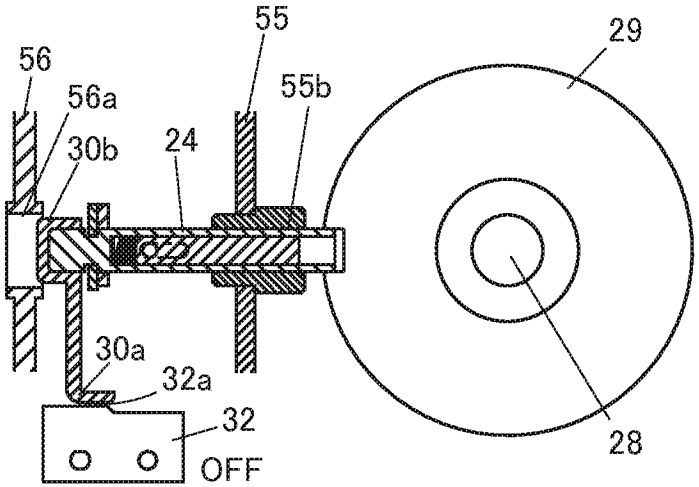
FIG. 8D is a view showing a relationship between the motor switch cap 30 and the micro switch 32 in the state in which switching to the threading state is completed.

FIG. 8D is a view showing a relationship between the motor switch cap 30 and the micro switch 32 in the state in which switching to the threading state is completed.

When the thread take-up lever (not shown) is manually rotated to the near side from a state in which the threading switching knob 64 is being rotated counterclockwise as shown in FIG. 7A to FIG. 7D, the main shaft fixing plate 29 is rotated accompanying the rotation of the main shaft 28 and the notch 29*a* of the main shaft fixing plate 29 reaches the phase at which the main shaft fixing outer shaft 24 stands by. At that moment, the main shaft fixing outer shaft 24 that had been urged in the central axial direction of the main shaft fixing plate 29 plunges into the notch 29*a* whereupon the main shaft fixing outer shaft 24 and the notch 29*a* fit with each other. Since the main shaft fixing outer shaft 24 is continuously urged in the central axial direction of the main shaft fixing plate 29 through the action of the main shaft fixing operating spring 21, the fitting of both members is continued.

At this time, the switch contacting surface 30*a* of the motor switch cap 30 continuously keeps on pressing the button 32*a* of the micro switch 32 and the motor driving power source is in the OFF state.

Since the main shaft fixing outer shaft 24 has moved rearward, the small diameter portion 24*b* of the main shaft fixing outer shaft 24 and the long hole portion 6*f* of the slide plate 6 coincide, so that the slide plate 6 moves in the left direction through the urging force of the supporting plate shaft spring 10. Accompanying this, the two slide pipes 4 also move in the left direction and the left ends of the slide pipes 4 pierce through the round holes 23*a*, 23*b* of the looper thread take-up guide 23 and further pierce through the upper looper thread hook 3*a* and the lower looper thread hook 3*b* of the looper thread take-up 3 to respectively reach the upper looper receiving opening 1*a* and the lower looper receiving opening 2*a*.

By means of the switch interlocking arm 62 fixing the threading switching knob 64, the spherical protrusion 62*e* on one end coincides with the concave portion 61*b* of the interlocking arm receiver 61, so that the threading switching knob 64 stably maintains at the position of the threading state.

As explained so far, since switching between the threading state and the sewing executable state is performed by only the rocking operations of the threading switching knob 64, it is not only possible to enable operation with one hand but also to reduce parts that need to be operated when compared to the prior art. Accordingly, it is possible to easily perform switching between the threading state and the sewing executable state with the overlock sewing machine according to the present embodiment.

Moreover, since the identification window 56*a* enabling identification of the threading state and the sewing executable state with at a glance and a safety device (motor switch cap 30, micro switch 32), for enabling/disabling driving of the motor interlocking therewith, the overlock sewing machine according to the present embodiment is of high safety and of high utility.

Modified Embodiment

The present invention is not limited to the above explained embodiment but various modifications and changes are possible which are also included in the present invention.

(1) The present embodiment has been explained by giving an example in which the relationship between the main shaft fixing outer shaft 24 as the first shaft and the main shaft fixing inner shaft 26 as the second shaft is such that the first shaft side is located outside and the second shaft side is located inside. The present invention is not limited to this arrangement, and it can be arranged in that the first shaft side is located inside and the second shaft side is located outside. Further, the invention is not limited to an embodiment in which one shaft is inserted into the interior of the other shaft, and any arrangement in which both members are relatively movable in an axial direction allow, or any embodiment including, for instance, a case in which a rail-like guide portion is provided allow.

(2) The present embodiment has been explained by giving an example in which the fixing inner shaft pin 27 as the shaft pin is provided at the main shaft fixing inner shaft 26 as the second shaft. The present invention is not limited to this arrangement, and, for instance, the shaft pin allow be provided on the rocking lever portion side. In this case, it is preferable to provide a long hole shape or the like on the second shaft for enabling movements of the second shaft even when the shaft pin moves in an arc-like shape.

(3) The present embodiment has been explained by giving an example in which the pin 19*b* of the switch limiting arm 19 is configured to engage with the arms 62*c*, 62*d* of the switch interlocking arm 62. The present invention is not limited to this arrangement, and forms for engaging these members are suitably changeable and it is, for instance, allow to provide two arms on the switch limiting arm 19 side and by providing one pin on the interlocking arm 62 side or the like.

In this respect, while the embodiment and the modified embodiments can be used upon suitably combining them, detailed explanations will be omitted. The present invention is not to be limited by the above explained respective embodiments.

REFERENCE SIGNS LIST

A Looper portion
B Air flow path switching mechanism
C Looper thread path
D Main shaft fixing mechanism
1 Upper looper
1*a* Upper looper receiving opening
1*b* Pipe-like member
1*c* Upper looper point
2 Lower looper
2*a* Lower looper receiving opening
2*b* Pipe-like member
2*c* Lower looper point
3 Looper thread take-up
3*a* Upper looper thread hook
3*b* Lower looper thread hook
4 Slide pipe
4*a* Flange portion

4*b* One end of slide pipe
4*c* Other end of slide pipe
5 Slide pipe spring
6 Slide plate (slide member)
6*a* U groove
6*b*, 6*c* Round hole
6*d* Long hole
6*e* Wide hole portion
6*f* Kong hole portion
6*g* Pin
6*h* Heteromorphic long hole
7 Looper pipe supporting plate
7*a*, 7*b* Through hole
7*c*, 7*e* Right side surface hole
7*d*, 7*f* Left side surface hole
8 Supporting plate shaft
9, 15, 17, 66 E-shaped snap ring
10 Supporting plate shaft spring
12 Upper looper conducting pipe
12*a* Linear portion
12*b* Upper end expanding portion
13 Lower looper conducting pipe
13*a* Linear portion
13*b* Upper end expanding portion
14 Slide plate support
14*a* Pin with E-grooves
14*b* Round hole
14*c*, 14*d* Through hole
14*e* Arc-shaped long hole
14*f* Small hole
16 Main shaft fixing operating shaft
19 Switch limiting arm (switch limiting portion)
19*a* Pin
19*b* Pin
20 Main shaft fixing operating arm (main shaft fixing operating arm
portion)
20*a* Pin
20*b* Shaft pin engaging portion
21 Main shaft fixing operating spring
23 Looper thread take-up guide
23*a*, 23*b* Round hole
24 Main shaft fixing outer shaft (first shaft)
24*a* Side surface long hole (engaging portion)
24*b* Small diameter portion
24*c* Large diameter portion
24*d* One end of main shaft fixing outer shaft
25 Fixing inner shaft spring (shaft spring)
26 Main shaft fixing inner shaft (second shaft)
27 Fixing inner shaft pin (shaft pin)
28 Main shaft
29 Main shaft fixing plate
29*a* Notch
30 Motor switch cap (identification member)
30*a* Switch contacting surface
30*b* Boss portion
32 Micro switch
32*a* Button
33 switch mounting plate
36 Tube
44 Branching body
45 Looper selecting knob
48*a* Upper looper thread inserting hole
48*b* Lower looper thread inserting hole
50 Branching base plate
51 Screw
54*a* Upper looper thread discharge pipe
54*b* Lower looper thread discharge pipe
55 Unit base
55*a* Switch shaft
56 Front surface cover (casing member)
56*a* Identification window (aperture portion)
58 Upper looper thread
59 Lower looper thread
61 Interlocking arm receiver
61*a*, 61*b* Concave portion
61*c* Screw
62 Switch interlocking arm (switch interlocking portion)
62*a* Boss portion
62*b* Arm (slide member engaging portion)
62*c* Arm (switch engaging portion)
62*d* Arm (switch engaging portion)
62*e* Spherical protrusion
63 Washer
64 Threading switching knob (switch operating portion)

The invention claimed is:

1. An overlock sewing machine comprising:

at least one looper including an receiving opening for receiving a looper thread and having a hollow structure through which the looper thread passes;

a thread inserting opening into which the looper thread to be inserted to the looper is inserted;

a looper conducting pipe which guides the looper thread inserted into the thread inserting opening towards the receiving opening;

a slide pipe disposed between the looper conducting pipe and the receiving opening and which one end is fitted to the looper conducting pipe in a freely slidable manner while its other end is disposed to be movable between a threading position at which it is connected to the receiving opening and a sewing executing position at which the other end is separated from the receiving opening;

a slide member which is a member holding the slide pipe and moving between the threading position and the sewing executing position together with the slide pipe, having a long hole portion extending along the moving direction and a wide hole portion being formed and connected with the long hole portion having a width formed to be larger than the width of the long hole portion;

a slide member spring urging the slide member and the slide pipe towards the receiving opening side;

a main shaft which is rotationally driven;

a main shaft fixing plate being fixed to the main shaft and including a notch at an outer peripheral position corresponding to a threading phase at which the receiving opening and the other end of the slide pipe are at a connectable position;

a first shaft which is an axial member which one end is disposed to be movable between an engaging position at which it engages with the notch for fixing the main shaft at the threading phase and a retracted position at which it is completely separated from the main shaft fixing plate and comprising a small diameter portion and a large diameter portion at the other end thereof which respectively engage with the long hole portion and the wide hole portion of the slide member, wherein the position of the sliding member is maintained at each of the threading position and the sewing executing position through the engagement of the small diameter portion and the large diameter portion with the long hole portion and the wide hole portion;

a second shaft disposed to be relatively movable along an axial direction of the first shaft;

a shaft spring for urging the first shaft and the second shaft in mutually separating directions;

a shaft pin disposed at the second shaft to project from the second shaft or engaging with the second shaft to be integrally movable in an axial direction of the second shaft;

an engaging portion disposed at the first shaft to engage with the shaft pin and/or the second shaft to receive force to move the first shaft towards the main shaft fixing plate side;

a rocking lever portion including a main shaft fixing operating arm portion disposed with a shaft pin engaging portion which engages with the shaft pin or with the shaft pin and a switch limiting portion being rockable integrally with the main shaft fixing operating arm portion and being disposed to be rockable within a predetermined range;

a main shaft fixing operating spring which urging direction is switched to both rocking directions of the rocking lever portion by exceeding a neutral point through rocking operations of the rocking lever portion;

a switch operating portion disposed to be operable by a user; and a switch interlocking portion including switch engaging portions being actuated through operation of the switch operating portion and engaging with the switch limiting portion so as to rock the rocking lever portion and including a slide member engaging portion being engageable with the slide member so as to move the position of the slide member to the sewing executing position upon operating the switch operating portion to the sewing executing position side.

2. The overlock sewing machine according to claim 1, comprising:

a casing member formed with an opening portion visible at least to the user at the time of operation, wherein a part of the first shaft and/or a part of an identifying member moving integrally with the first shaft comes to a position at which it is exposed from the opening portion when the first shaft has moved to the retracted position to indicate that the sewing machine is in a sewing executable state in which the slide pipe and the slide member have moved to the sewing executing position so as to enable sewing.

3. The overlock sewing machine according to claim 2, comprising:

a switch allowing driving of a motor for driving the main shaft only when the first shaft has moved to the retracted position so that the sewing machine is in a sewing executable state so as to enable sewing.

4. The overlock sewing machine according to claim 1, comprising:

a switch allowing driving of a motor for driving the main shaft only when the first shaft has moved to the retracted position so that the sewing machine is in a sewing executable state so as to enable sewing.

* * * * *